US005522773A

United States Patent [19]

Rich

[11] Patent Number: 5,522,773

[45] Date of Patent: Jun. 4, 1996

[54] TWO PERSON ROCKER WITH PIVOTING SEATS

[76] Inventor: Rolland W. Rich, 3513 Gillionville Rd., Albany, Ga. 31707

[21] Appl. No.: 534,027

[22] Filed: Sep. 26, 1995

Related U.S. Application Data

[63] Continuation of Ser. No. 291,064, Aug. 8, 1994, abandoned.

[51] Int. Cl.[6] ..... A63G 13/06

[52] U.S. Cl. ..... 472/114; 472/111; 472/102

[58] Field of Search ..... 446/29, 396; 472/95, 472/96, 97, 100, 102, 109, 111, 114, 118

[56] References Cited

U.S. PATENT DOCUMENTS

| | | | |
|---|---|---|---|
| 24,299 | 6/1859 | Griswold | 472/114 |
| 367,477 | 8/1887 | Vanetten | 472/114 |
| 1,039,699 | 10/1912 | Converse | 472/102 |
| 1,660,139 | 2/1928 | Shellabarger | D21/251 |
| 1,677,844 | 7/1928 | Patton | 472/118 |
| 2,043,894 | 6/1936 | Husted | 472/111 |
| 2,448,325 | 8/1948 | Poorman, Jr. | 472/118 |
| 2,928,674 | 3/1960 | Foster | 472/100 |
| 3,038,722 | 6/1962 | Elfstrom | 472/102 |
| 3,096,120 | 7/1963 | Campbell | 472/114 |
| 4,003,571 | 1/1977 | Nipper | 472/114 |
| 4,228,999 | 10/1980 | Armstrong | 482/78 |

FOREIGN PATENT DOCUMENTS

| | | | |
|---|---|---|---|
| 953395 | 12/1949 | France | 472/102 |
| 251282 | 12/1926 | Italy | 472/121 |

*Primary Examiner*—Sam Rimell
*Assistant Examiner*—Jeffrey D. Carlson
*Attorney, Agent, or Firm*—Finnegan, Henderson, Farabow, Garrett & Dunner

[57] ABSTRACT

A rocking device for use as a toy incorporating several safety features to prevent the device from tipping over and the riders from falling off their seats or otherwise sustaining injuries during use. The rocking device includes a pair of substantially parallel siderails each having an upper portion and a curved lower portion. At least one horizontal member connects the pair of siderails. A pair of seats pivot from points on the upper portions of the siderails and remain substantially parallel to the ground during rocking of the pair of siderails.

6 Claims, 2 Drawing Sheets

TWO PERSON ROCKER WITH PIVOTING SEATS

This application is a continuation of application Ser. No. 08/291,064 filed Aug. 8, 1994, abandoned.

BACKGROUND OF THE INVENTION

1. Field of the Invention

The present invention relates to a rocking device for use as a toy. In particular, the invention relates to a rocking device incorporating several safety features to prevent the device from tipping over and the riders from falling off the seats or otherwise sustaining injuries during use.

2. Description of the Related Art

Rocking devices, seesaws, and other similar toys provide fun and amusement for young children. However, many conventional devices include various safety risks. For example, conventional rocking devices are often subject to tipping over either sideways or in the rocking direction. Further, as the device rocks, riders occasionally slide forward or backward off their seats and incur serious injuries. Riders may also pinch their fingers and toes during use. As their hands are commonly positioned underneath the seats, fingers are pinched between the seat and the ground should the seat hit the ground in an extreme rocking position. Toes are often similarly crushed between the ground and siderails.

SUMMARY OF THE INVENTION

Accordingly, the present invention is directed to a rocking device incorporating several features to overcome many of the safety problems and other disadvantages of conventional rocking devices and seesaws. The rocking device according to the present invention accomplishes these objectives while remaining relatively inexpensive to manufacture and easy to transport and assemble.

Additional features and advantages of the invention will be set forth in the description which follows, and in part will be apparent from the description, or may be learned by practice of the invention. The objectives and other advantages of the invention will be realized and attained by the apparatus particularly pointed out in the written description and claims hereof, as well as the appended drawings.

To achieve these and other advantages and in accordance with the purpose of the invention, as embodied and broadly described herein, the invention comprises a rocking device including a pair of substantially parallel siderails each having an upper portion and a curved lower portion. At least one horizontal member connects the pair of siderails. A pair of seats pivot from points on the upper portions and remain substantially parallel to the ground during rocking of the pair of siderails.

It is to be understood that the foregoing general description and the following detailed description are exemplary and explanatory and are intended to provide further explanation of the invention as claimed.

DESCRIPTION OF THE DRAWINGS

The accompanying drawings are included to provide a understanding of the invention and are incorporated in and constitute a part of this specification, illustrate preferred embodiments of the invention, and, together with the description, serve to explain the principles of the invention.

DESCRIPTION OF THE PREFERRED EMBODIMENTS

Figure 1:
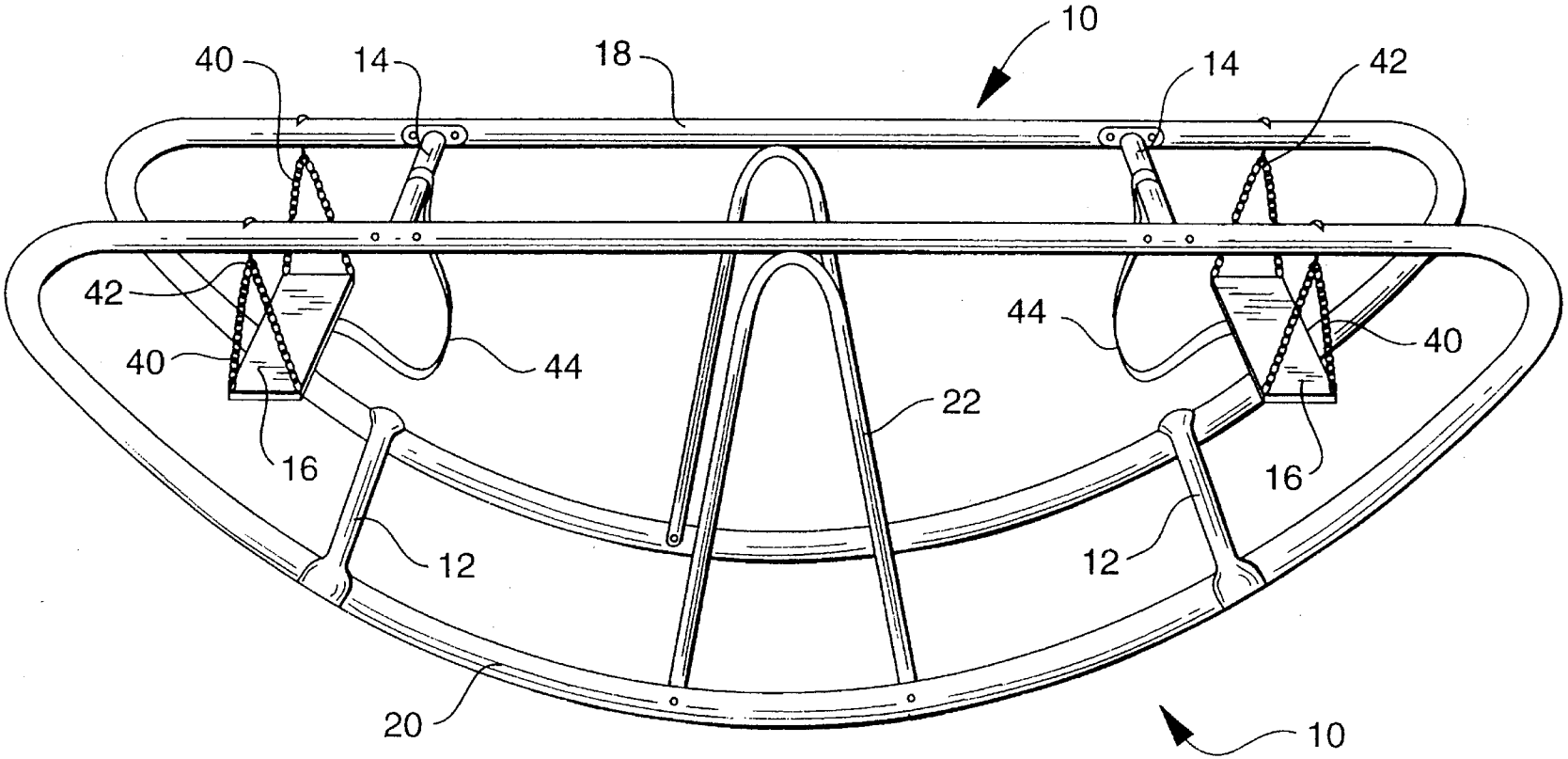
FIG. 1 is a perspective view of the rocking device according to an embodiment of the present invention.

Reference will be made in detail to the present preferred embodiment of the invention, examples of which are illustrated in the accompanying drawings. Like reference numerals refer to like parts in the various Figures of the drawings.

As shown in FIG. 1, the rocking device according to the present invention includes as its main components a pair of siderails 10, horizontal members 12 and 14 connecting the siderails 10, and seats 16 pivoting from the siderails 10. Inexpensive, commercially available materials comprise all of these components to allow for low production costs. Further, the small number of components and interconnections ease transport and assembly of the rocking device.

Referring once again to FIG. 1, the siderails 10 are substantially parallel and, in the preferred embodiment, separated by approximately nineteen and one-half inches (19½"). Each siderail 10 includes a straight upper portion 18, a curved lower portion 20 that contacts the ground, and a support member 22. The upper portion 18 preferably has a length of approximately five feet (5') and, as well as the lower portion 20, a diameter of one and one-half inches (1½"). As most clearly shown in FIG. 2, the angle Θ between the upper portion 18 and lower portion 20 is approximately fifty-five degrees (55°).

Figure 2:
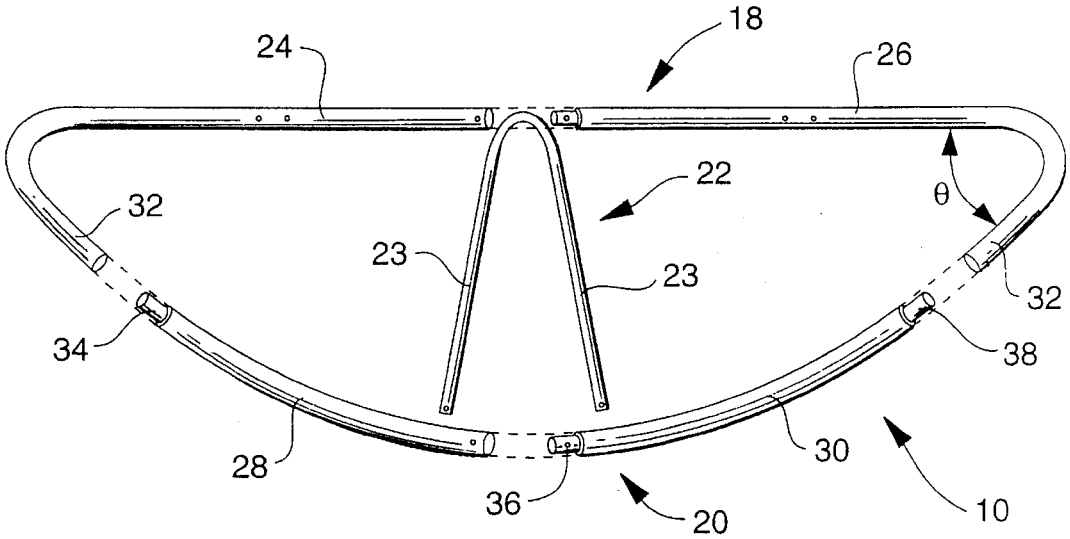
FIG. 2 is an exploded view of the various components of a siderail of the rocking device according to FIG. 1.

FIG. 2 further indicates the preferred components of each siderail 10, which is constructed of five parts, support member 22, upper sections 24 and 26, and lower sections 28 and 30. As the siderails 10 are the largest parts of the rocking device, these components ease transport while also allowing ease of assembly. In the preferred embodiment, all five parts are hollow tubular members comprised of cold rolled steel, providing sufficient strength and stability to the rocking device. However, each siderail 10 can be made from a variety of materials, a number of parts, and in a variety of ways, as will be apparent to persons skilled in the art after reviewing this disclosure.

Support member 22 includes two legs 23 each preferably measuring approximately two and a half feet (2½') in length and one inch (1") in diameter. The legs are separated at the bottom of support member 22 by approximately one foot (1'). Each upper portion 24 and 26 includes a 55° angled bend, as described hereinabove, and a straight section 32, as shown in FIG. 2, that is preferably about eight inches (8") long. Lower sections 28 and 30 respectively connect with upper sections 24 and 26 at the straight sections 32. In the preferred embodiment, lower section 28 is approximately forty-two inches (42") in length with a single swaged end 34 for connection with the straight section 32 of upper section 24. Lower section 30 is approximately forty-four inches (44") in length with two swaged ends 36 and 38 for connection with, respectively, lower section 28 and straight section 32 of upper section 26. Once assembled, the various components of the siderail 10 may be secured by cap screws and bolts or other connectors known in the art.

As shown in FIG. 1, two pairs of horizontal members 12 and 14 connect the siderails 10. Hollow steel tubes preferably comprise the members 12 and 14, which are secured to the siderails 10 through braces and bolts. An assortment of other known materials and modes of connection may be suitable. Horizontal members 14 connect the upper sections 18 and also may serve as handles for the rider of the rocking device. Similarly, members 12 connect the lower sections 20 of the siderails 10 and may function as footrests. For safety, members 12 are positioned slightly above the lower portions 20, as most clearly shown in FIG. 3.

Two seats 16, preferably comprised of plastic and having dimensions of approximately five inches (5") by twenty-two inches (22"), pivot from the top sections 18 of the siderails 10. In the preferred embodiment, chain links 40 attach to both ends of each seat 16. The links hang from eyebolts 42 bolted to the top sections 18 of the siderails 10. Other modes of connecting the seats 16 to the top sections 18 include, inter alia, metal wire, steel cable, nylon rope, or a bent hard metal rod.

Figure 3:
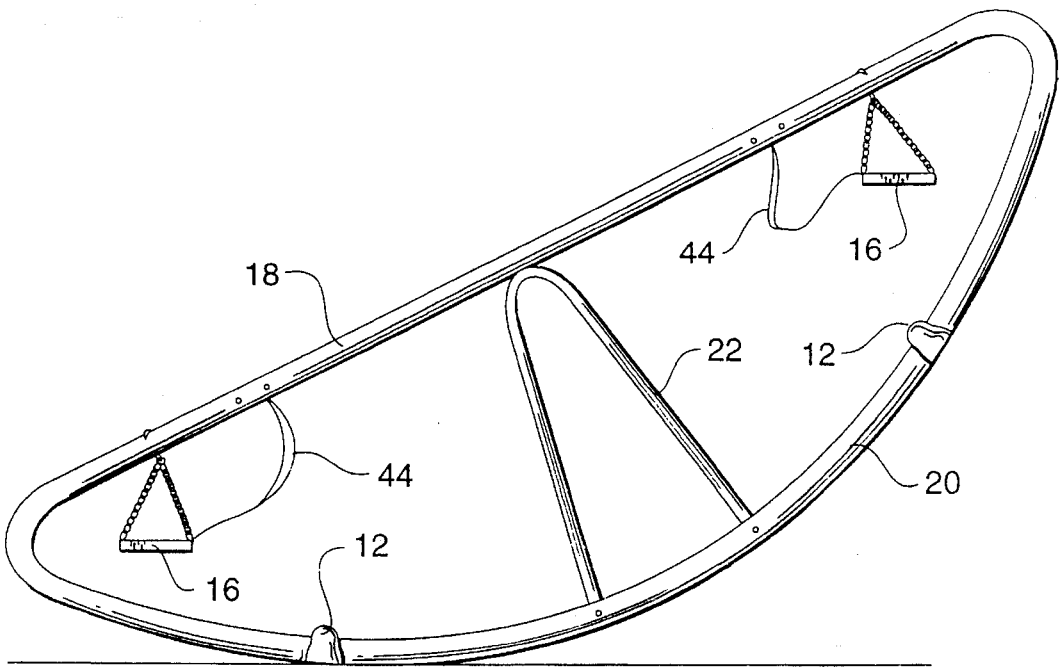
FIG. 3 is a side view of the rocking device of FIG. 1 showing a rocking position thereof.

The rocking device according to the present invention incorporates several safety features to prevent the device from tipping over and the riders from falling off the seats or otherwise sustaining injuries during use. As shown in FIG. 3, when the device is in a rocked position, the seats 16 remain substantially parallel to the ground so as to prevent the rider from sliding forward or backward off the seat. As the device rocks, the seats 16 pivot from the top sections 18 of siderails 10.

A safety strap 44 loops around each horizontal member 14 and connects to the corresponding seat 16. Should a rider accidently lean too far forward, the safety strap 44 prevents the rider from falling to the ground. Preferably, each strap 44 measures approximately thirty inches (30") in length and two inches (2") in width and is comprised of a flexible webbed material such as polypropylene or nylon for sufficient strength.

The rocking device incorporates several other safety features to prevent it from tipping over during use. First, as the seats 16 hang a substantial length below the top sections 18 of the siderails 10, a low center of gravity is maintained. In the preferred embodiment, the seats 16 are located eight inches (8") inches below the top section 18 of the siderail 10. Further, the design of the siderails 10 precludes the seats 16 from hitting the ground and also prevents the entire rocking device from tipping over. The large (55°) angled bends and 8" straight sections 32 constrain the device from extreme rocking. As the degree of rocking is controlled, the seats 16 avoid hitting the ground so as to not jar the rider. This further avoids pinching of the rider's fingers between the seat and the ground, as often occurs in conventional rocking devices and seesaws.

The 19½ inch separation between siderails 10 enhances stability to decrease the risk of the device tipping over sideways. The separation additionally prevents injury to a rider's toes as they will not be positioned underneath the siderails 10.

It will be apparent to those skilled in the art that various modifications and variations can be made in the rocking device of the present invention without departing from the spirit or scope of the invention. Thus, it is intended that the present invention cover the modifications and variations of this invention provided they come within the scope of the appended claims and their equivalents.

What is claimed is:

1. A rocking device comprising:

a pair of substantially parallel siderails each having an upper portion and a curved lower portion;

at least one horizontal member connecting the pair of siderails;

a pair of seats each pivotally attached to points on the upper portions and remaining substantially parallel to the ground during rocking of the pair of siderails; and wherein the pivotal attachment includes a pair of supports corresponding to and connecting each of the pair of seats to the upper portion, each of said pair of supports having two legs each connected to a corner of the corresponding seat and to the upper portion.

2. The rocking device as recited in claim 1, wherein the lower portion includes straight sections adjacent the ends of the upper portion.

3. The rocking device as recited in claim 2, wherein the angles between the upper portion and the straight sections of each rail are approximately 55°.

4. The rocking device as recited in claim 1, wherein the at least one horizontal member includes two horizontal members each connecting the upper portions proximate the points from which each of the pair of seats pivots, each of the two horizontal members serving as a handle.

5. The rocking device as recited in claim 4, further comprising a pair of safety straps, each safety strap connecting one of the pair of seats to a corresponding one of the two horizontal members.

6. The rocking device as recited in claim 1, wherein each of said pair of seats consists essentially of a flat seat section.

* * * * *